US012420170B2

(12) United States Patent
Liebl

(10) Patent No.: US 12,420,170 B2
(45) Date of Patent: Sep. 23, 2025

(54) ADJUSTABLE WEIGHTING SYSTEM FOR A CUE STICK

(71) Applicant: McDermott Cue Mfg., LLC, Menomonee Falls, WI (US)

(72) Inventor: Larry Liebl, Cedarburg, WI (US)

(73) Assignee: McDermott Cue Mfg., LLC, Menomonee Falls, WI (US)

( * ) Notice: Subject to any disclaimer, the term of this patent is extended or adjusted under 35 U.S.C. 154(b) by 251 days.

(21) Appl. No.: 17/548,685

(22) Filed: Dec. 13, 2021

(65) Prior Publication Data

US 2022/0096914 A1 Mar. 31, 2022

Related U.S. Application Data

(63) Continuation of application No. 16/218,081, filed on Dec. 12, 2018, now Pat. No. 11,224,795.

(51) Int. Cl.
*A63D 15/08* (2006.01)

(52) U.S. Cl.
CPC ..... *A63D 15/08* (2013.01)

(58) Field of Classification Search
None
See application file for complete search history.

(56) References Cited

U.S. PATENT DOCUMENTS

| | | | | |
|---|---|---|---|---|
| 942,486 A | | 12/1909 | Dall | |
| 1,705,353 A | | 3/1929 | Barrett | |
| 1,895,417 A | | 1/1933 | Lard | |
| 3,232,613 A | | 2/1966 | Laube | |
| 3,372,932 A | * | 3/1968 | Molis | A63D 15/08 473/297 |
| 4,949,964 A | * | 8/1990 | Jolly | A63D 15/086 473/48 |
| 5,462,490 A | | 10/1995 | Donwen | |
| 5,465,967 A | * | 11/1995 | Boeckenhaupt | A63B 60/24 473/297 |
| 5,782,693 A | | 7/1998 | Jordan | |

(Continued)

FOREIGN PATENT DOCUMENTS

| | | |
|---|---|---|
| CN | 207493184 | 6/2018 |
| CN | 208145424 | 11/2018 |
| FR | 688023 | 8/1930 |

OTHER PUBLICATIONS

European Search Report dated May 4, 2020 cited in EP Patent Application No. 19215317.9.

*Primary Examiner* — Eugene L Kim
*Assistant Examiner* — Christopher Glenn
(74) *Attorney, Agent, or Firm* — Andrus Intellectual Property Law, LLP

(57) ABSTRACT

A cue for use in billiard games includes a removable weight system located in a bore in a butt section of the cue. The weight system includes a carrier having a length extending from a first end to a second end with one or more weights and two or more support washers supported on the carrier. A butt plate is secured to the first end of the carrier, the butt plate having a first end and a second end and including an opening extending from the first end to the second end, the opening having a circular cross section at a second end for receiving the carrier of the weight system. The one or more weights and the two or more washers may be set at different locations along the length of the carrier.

19 Claims, 4 Drawing Sheets

(56) References Cited

U.S. PATENT DOCUMENTS

| | | | | |
|---|---|---|---|---|
| 6,165,078 | A | 12/2000 | Holt | |
| 6,712,712 | B2 | 3/2004 | Bourque | |
| 6,939,237 | B1 * | 9/2005 | Voden | A63D 15/08 473/44 |
| 7,431,655 | B2 | 10/2008 | McCarty et al. | |
| 2002/0065141 | A1 | 5/2002 | Liao | |
| 2005/0043107 | A1 * | 2/2005 | Kuo | A63D 15/08 473/44 |
| 2005/0079925 | A1 | 4/2005 | Cheng | |
| 2006/0264266 | A1 * | 11/2006 | Jung | A63B 53/02 473/282 |
| 2007/0010340 | A1 | 1/2007 | Kazunori | |
| 2009/0111595 | A1 | 4/2009 | Owen | |
| 2009/0111596 | A1 | 4/2009 | Owen | |
| 2010/0160055 | A1 * | 6/2010 | Suit | A63D 15/08 473/44 |
| 2012/0190467 | A1 | 7/2012 | Liebl | |
| 2014/0031146 | A1 | 1/2014 | Kelley | |

* cited by examiner

ADJUSTABLE WEIGHTING SYSTEM FOR A CUE STICK

CROSS-REFERENCE TO RELATED APPLICATION

The present application is a continuation of U.S. patent application Ser. No. 16/218,081, filed on Dec. 12, 2018 and published as U.S. Patent Application Publication No. 2020/0188766 on Jun. 18, 2020, the content of which is hereby incorporated by reference in its entirety.

BACKGROUND AND SUMMARY OF THE INVENTION

The present disclosure relates generally to weighted cue sticks used in cue sports and billiard sports, including but not limited to carom billiards, pool, snooker, and English billiards. Cue sticks are weighted to provide the desired heft and balance for a particular user. There is a need in the art to provide an adjustable weighting system that is user friendly and efficient to use.

While traditional cue sticks have a fixed weight and a fixed center of gravity position, players at times desire to customize a specific cue to meet particular individual characteristics. When a player progresses in skill, the player may desire to have cues with different properties, such as a heavier cue to increase the strength of hitting the ball or a cue having the center of gravity position closing to the tip.

United States Patent Application Publication No. 2005/0043107 to Kuo discloses a billiard cue that allows a player to change the weight and the position of the center of gravity thereof. The billiard cue of Kuo includes a shaft having a chamber therein, a bar detachably mounted in the chamber, and a weight adjuster movably mounted on the bar and fixed at various positions of the bar. Kuo's weight adjuster has two first weight devices made of plastic or metal having a cone end, a butt end, a thread hole from the cone end to the butt end, a cone slot at an end of the thread hole at the butt end, and an annular pad at a periphery of the butt end. Kuo's weight adjustment also has two second weight devices made of a heavier material like copper or lead and having a cone end, a butt end, a through hole from the cone end to the butt end, a cone slot at an end of the through hole at the butt end, and an annular pad at a periphery thereof adjacent to the cone end. These first and second weight devices are screwed onto a removable threaded bar that is removable from an interior chamber formed in the butt end of the cue from the butt end. The first weight devices serve as both functions of increasing weight and adjusting and fixing the position of the second weight devices, while the second weight devices only serve the function of increasing weight. In operation, a threaded bar is removed from the cue chamber from the butt end and one of the first weight devices is screwed onto the threaded bar. Next, one of the second weight devices is screwed onto the threaded bar, and then the other second weight device is screwed onto the threaded bar. Finally, the final first weight devices is screwed onto the threaded bar. After that, the bar 28 with the first and second weight devices secured thereon is inserted into the chamber of the butt end of the cue shaft. A distal end of the threaded bar is screwed into a thread hole at the terminal of the chamber. Finally, a plug portion is inserted into the chamber and a handle is attached onto the butt end. Accordingly, the weight adjuster of Kuo is increases and decreases the weight of a cue by adding or removing the second weight devices to the removable threaded bar, and the position of the first and second weight devices is adjusted by screwing the first weight devices to particular desired positions on the threaded bar. This process can be very time consuming and imprecise.

Moreover, the design of Kuo is limiting in other manners. As shown in FIG. 1 of Kuo, the chamber 22 only extends about halfway into the rear or butt section 14 of the cue. This is due to the fact that the chamber 22 is bored (i.e. drilled with thread hole) from a finished butt section 14. Such boring is challenging because it is difficult to keep the boring tool (e.g. lathe) concentric with the axis. More often than not, the boring tool will wander off-center following the grain of the wood creating a chamber 22 that is not concentric with the axis of the butt section 14. This is problematic because when any weight is added to a non-concentric chamber the balance of the cue is distorted. A second issue arises with the depth of the chamber 22. As one of ordinary skill in the art will recognize, the butt portion of the cue tapers forwardly. Accordingly, the walls of the butt section surrounding the bored chamber 22 become increasingly thinner as the butt portion tapers forwardly. This is problematic because the thinner walls create structural integrity issues with the butt section 14. It is also problematic because a user is limited in the location of the weight—i.e. the entirety of the length of the butt section is not available and weights may only be placed in the rear half of the butt section. This is problematic because a user cannot create a precise weight and balance point with most of the weight isolated in the rear half of the butt section.

Accordingly, it is desirable to overcome the drawbacks of prior art cue weight systems and provide a cue that can be constructed and assembled quickly, more efficiently and with a higher quality that previously known, while further permitting precise and efficient weight adjustment.

In that regard, the present disclosure relates to a cue having a butt section, a joint collar and a shaft section terminating in a cue tip. The butt section of the cue has a bore extending throughout an entire length of the butt section from a first end to a second end. The second end of the butt section terminates in a bumper and is located at a distal end of the cue opposite the tip and includes threads for receiving a butt plate as described herein. A support tube coextensive in length with the bore is secured in the bore of the butt section and has a circular cross section with the outer circumference of the support tube corresponding to the circumference of the bore such that the support tube may be securely located in the bore. The support tube may have a threaded second end such that the support tube is secured in the bore of the butt section by engaging the threads of the second end of the support tube with corresponding threads in the second end of the bore of the butt section. A connecting dowel may be secured to a second end of the support tube, the connecting dowel connecting the butt section to the shaft section. The connecting dowel may further include a threaded area and an unthreaded tenon extending from the threaded area that is received in the shaft section.

A weight system is removably insertable into the support tube. The weight system includes a carrier having a length coextensive with the length of the support tube and the bore, extending from a first end to a second end. The carrier supports one or more weights and two or more support washers thereon. Importantly, the one or more weights and the two or more washers may be set at different locations along the length of the carrier and are slidably moveable along the entire length of the carrier, and therefore along the entire length of the support tube and butt section. In certain examples, two or more weights are utilized. In still other examples, three or more weights or four or more weights are utilized. The number of weights will depend on the size of the weights and the length on the carrier. The carrier may include a reference designation system to allow a user to identify a neutral or standard location for the weights on the carrier, and giving a user reference points when the user adjusts the location of the weights along the length of the carrier. The one or more weights may include at least one recessed screw for releasing and securing each weight at a desired location along the length of the carrier. The weights are cylindrical and have a circular cross section that is smaller than the cross section of the support tube. Likewise, the support washers are cylindrical and have a circular cross section that is smaller than the cross section of the support tube.

The butt plate is secured to the first end of the carrier. The butt plate includes threads that engage the threads at the second end of the butt section such that the butt plate is secured to the second end of the butt section, thereby securing the weight system in the support tube. The butt plate may include an opening extending therethrough from a first end to a second end. The opening has a circular cross section at the second end for receiving the carrier of the weight system, while the opening at the second end has a hexagonal cross section for receiving a tool such as an Allen wrench for screwing and unscrewing the threads of the butt plate from the threads of the butt section. As such, the weight system and butt plate are removable as a single piece from the support tube of the butt section.

The present disclosure is also directed to a weight system for a cue used in billiards games. The weight system includes a carrier having a length extending from a first end to a second end. One or more weights and two or more support washers are slidably supported on the carrier. A butt plate is secured to the first end of the carrier, and the butt plate has a first end and a second end with an opening extending from the first end to the second end. The opening has a circular cross section at a second end for receiving the carrier of the weight system. The one or more weights and the two or more washers may be set at different locations along the length of the carrier. The one or more weights may include at least one recessed screw for securing each weight at a desired location along the length of the carrier. Alternatively, the system includes two or more weights, three or more weights or four or more weights. In one embodiment the weights are cylindrical. In one embodiment the weights are all of the same weight. In another embodiment, the weights have different lengths and weights.

Some embodiments of the invention relate to a variable balance weight system configured to be received in a butt section of a cue used in billiards games. the variable balance weight system may include a support tube configured to be received in the butt section of the cue and a carrier configured to be removably received in the support tube. At least one weight and a plurality of support washers may be slidably supported on the carrier, and a butt plate may be secured to a first end of the carrier. A reference designation system may establish a neutral location for the at least one weight on the carrier based on a center of gravity of the cue, and the at least one weight and the plurality of support washers may be adjusted to different locations along the length of the carrier based on the neutral location to adjust the balance of the cue.

BRIEF DESCRIPTION OF THE DRAWINGS

The best mode of carrying out the invention is described herein below with reference to the following drawing figures.

DETAILED DESCRIPTION

Figure 1:
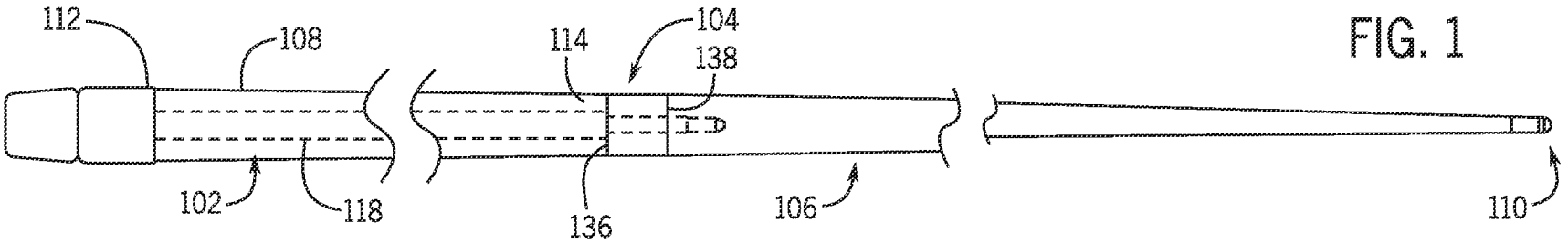
FIG. 1 is a exemplary drawing of a cue showing a bore for receiving the weight system of the present invention.

Referring now to FIG. 1, thereshown is a construction of a cue 100 in accordance with the present disclosure. The cue 100 is generally comprised of a hollow shaft arrangement or butt section 102, a joint collar 104 and a shaft section 106 having a cue tip 110. In the examples shown, the butt section 102 is preferably fabricated of, but not limited to, a wood material of circular cross section, and is illustrated as a single or one piece, with an elongated hollow tube or shaft. It should be fully understood, however, that the hollow shaft arrangement of the butt section 102 may also be embodied as multiple hollow tubes, shafts and collars including rings and sleeves having various lengths and different circular cross sections. The butt section 102 preferably has a circular cross section that may vary along the length thereof, typically decreasing in an outer diameter surface 108 from a first end 112 to a second end 114. A bore 118 having a substantially constant circular cross section extends centrally throughout the entire length of the butt section 102 from the first end 112 to the second end 114 defining the hollow shaft arrangement.

Figure 2:
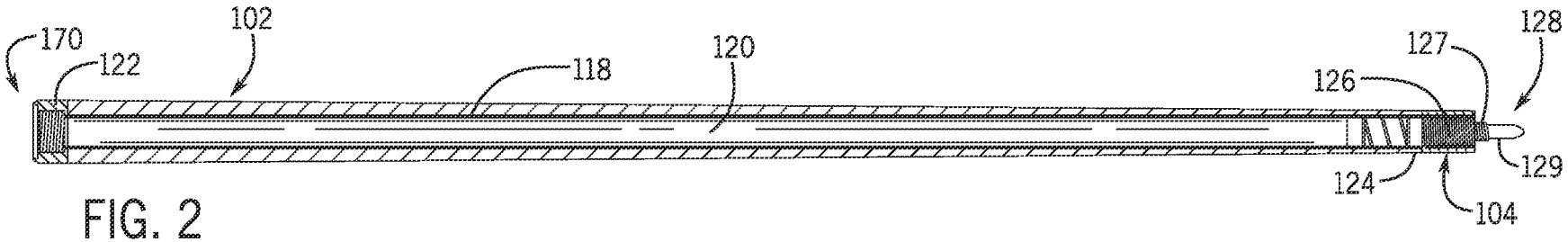
FIG. 2 is a partial sectional view of a butt section of a cue showing a support tube located in the bore.
Figure 3:
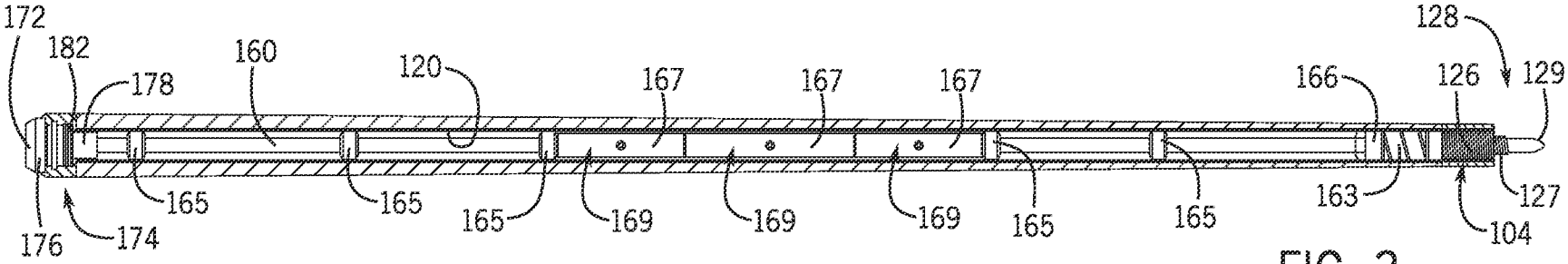
FIG. 3 is a partial sectional view of the butt section of a cue shown in FIG. 2 with the support tube also shown in section to demonstrate the weight system of the present application in the butt section.

Referring now to FIGS. 2 and 3, a support tube 120 is provided to securely fit within bore 118. The support tube 120 is coextensive with the length of the bore 118 and therefore runs the entire length of the bore 118. The support tube 120 may be cylindrical having a hollow center with a cylindrical cross section and an inner surface and an outer surface. Support tube 120 is preferably constructed of a carbon fiber composite, but may be constructed from plastics, metals or other materials that facilitate the functions of the support tube 120, as explained herein. The support tube 120 includes a first end 122 and a second end 124 terminating in an external thread 126. The support tube 120 is hollow and has openings at both the first end 122 and the second end 124. A connecting dowel 128 is secured in the second end 124 of the support tube 120. The connecting dowel 128 includes a threaded area 127 and an unthreaded tenon 129. The connecting dowel 128 is secured to the support tube 120 by screwing the threaded area 127 into the opening of the second end 124 of the support tube 120. To facilitate this, in some embodiments, the external thread 126 comprises a plastic insert 163 that receives the connecting dowel 128 and is removably received in the second end 124 of the support tube 120. Alternatively, the connecting dowel 128 itself or the insert 163 carrying the connecting dowel 128 may be secured in the support tube 120 by affixing the threaded area 127 or the insert 163 within the opening of the second end 124 by glue, epoxy, by threaded fit, or by another means or method that securely holds the connecting dowel in the opening of the second end 124 of the support tube 120.

Support tube 120 fits within bore 118 and is formed within the bore during manufacturing of the butt section 102 such that the external thread 126 is exposed proximal to the second end 114 of the butt section 102. The external thread 126 of the support tube 120 receives joint collar 104, leaving a portion of the threaded area 127 of the connecting dowel exposed to receive the shaft section 106 as described herein. Alternatively the external thread 126 may interact with corresponding threads in both the second end 114 of the butt section 102 and the joint collar 104.

Joint collar 104 preferably has a cylindrical outer surface 134 flanked by a first end face 136 and a second end face 138. Joint collar 104 is formed throughout its length with an internally threaded bore 140 which threadedly receives a portion of the threaded area 126 on support tube 120. As is known in the art, shaft section 106 has an inner end formed with a cylindrical chamber for receiving and retaining connecting dowel 128. The bore may be partially formed with threads and partially formed with a smooth surface extending towards a closed end wall to snuggly engage with threaded area 127 and the unthreaded tenon 129 of the connecting dowel 128.

Figure 4:
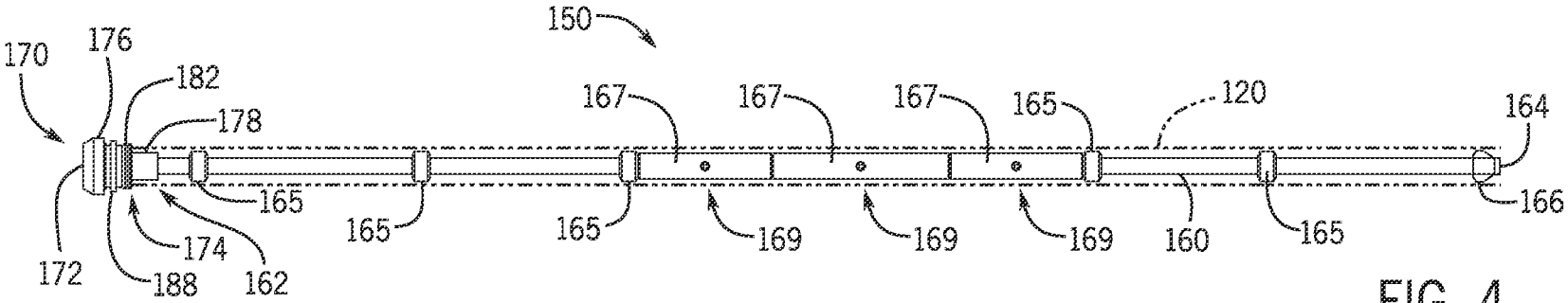
FIG. 4 is a plan view of the components of the weight system of the present disclosure.
Figure 6:
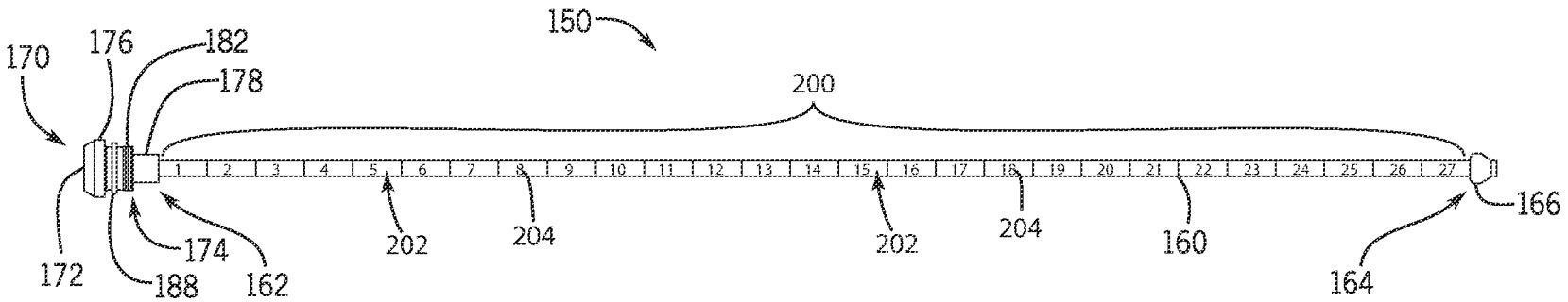
FIG. 6 is a perspective view of the carrier of the present invention demonstrating a reference designation system.

Referring now to FIGS. 3, 4 and 6, a removable variable balance point (VBP) weight system 150 is provided within support tube 120. The VBP weight system 150 includes a carrier 160 that may be constructed of carbon fiber, aluminum or other suitable material and a butt plate system 170, as described herein. The carrier 160 has a first end 162 and a second end 164 and a length that is coextensive with the length of the support tube 120. First end 162 of the carrier 160 receives the butt plate system 170, as will be described herein. Second end 164 of the carrier 160 terminates in a terminal washer 166 at or near the joint collar 104. Terminal washer 166 is preferably stationary and constructed of polyurethane or other durable plastic. Terminal washer 166 may be cylindrical or conical and includes an outer surface 168 that slidably engages an inner surface of support tube 120. Additional support washers 165 a present along the carrier 160, and likewise may be cylindrical or conical and have an outer surface for slidably engaging an inner surface of support tube 120. Support washers 165 operate to retain at least one weight 167 at a desired position along carrier 160 and are slidably moveable along the length of the carrier 160. Each weight 167 is cylindrical and has a hollow interior that engages with the carrier 160. Each weight 167 is slidably moveable along carrier 160, but is secured into a stationary position on carrier 160 to distribute the weight and heft desired by a user of the cue 100. In that regard, each weight 167 includes at least one recessed screw 169 that is used to secure the weight 167 at a desired position along the carrier 160. The present application envisions the use of one or more weights 167. In certain examples, only one weight 167 is needed to achieve the appropriate cue weight, heft and balance desired by the user. In other embodiments, two or more weights 167 are utilized to achieve the appropriate cue weight, heft and balance desired by the user. In still other examples three or more or four or more weights 167 are utilized to achieve the appropriate cue weight, heft and balance desired by the user. Weights 167 are preferably constructed of stainless steel, but may be constructed of any metal, including copper or lead, or other alloy or composite material that provides appropriate weight. Weights 167 may be of the same size and weight or of varying size or weight. Preferably one or more weights 167 are supported on carrier 160; more preferably two or more weights 167 or three or more weights 167 are supported on carrier 160. In other examples, four, five six, seven eight, nine or ten or more weights 167 of varying lengths and weights are supported on carrier 160. The weights may be of varying sizes, lengths and weights such that a user can select the desired weights to personalize the weights system for his or her cue 100. Support washers 165 may be placed on either end of a particular weight 167 to support the weight at a particular location along carrier 160. Alternatively, two or more weights 167 may be stacked adjacent to one another as shown in FIGS. 3 and 4, with support washers 165 at both ends of the stacked weights 167. In this instance the additional support washers 165 are spaced along carrier 160 to provide multiple engagement surfaces when the weights system 150 is placed within support tube 120. With the weight system 150 of the present application, weights 167 may be repositioned forward or backward inside the cue 100 and along the entire length of the carrier 160. This provides an unprecedented ease in controlling both the weight and balance of cue 100 because the weights 167 are able to be arranged along the entire length of the carrier 160, and therefore along the entire length of the support tube 120 and the butt section 102 including placing weight at or near the joint collar 104.

In one embodiment, the carrier 160 may include a reference designation system 200. The reference designation system extends the length of the carrier 160, and in one embodiment includes 3 to 30 discrete sections 202 each with a separate reference designator 204. As shown in FIG. 6, in one embodiment, the reference designation system 200 extends from the first end 162 of the carrier 160 to the second end 164 of the carrier 160, with each discrete section 202 being approximately one inch in length and having consecutive reference designators 204. In other words, in this embodiment, the reference designation system 200 extends the length of the carrier 160 and includes consecutively numbered sections 202 having designators 204 commencing with "1" at the first end 162 and extending to "27" at the second end 164. While the figures show the reference designators 204 as numbers, they may also be letters, characters or any other symbol. Moreover, the length and number of sections 202 is not limited, and reference designation system 200 along the length of the carrier 160 may be divided into any number of sections 202 and each section may be given any symbolic designator 204 as desired. The reference designation system 200 permits a cue manufacturer to establish a neutral or standard location for the weights 167 along the carrier 160 for a given cue model for the user to reference. Since any given cue model has a different center of gravity due to variations in the wood and materials that are used in each model, the neutral or standard location may be different for each model. Accordingly, when a given cue is manufactured, a user may designate a specific eight (in ounces) for a cue and the manufacturer may add a requisite number of weights 167 to the carrier 160 to achieve the proper weight of the cue 100. The manufacturer may then, for each cue 100, balance the cue to a neutral or standard balance by placing the weights 167 at the appropriate position on the carrier 160. The reference designation system 200 permits a user to identify where weights 167 are located on carrier 160 for a given neutral or standard position for a cue model, giving a user multiple reference points 202, 204 when adjusting the location of the weights 167 along the carrier 160.

Figure 5:
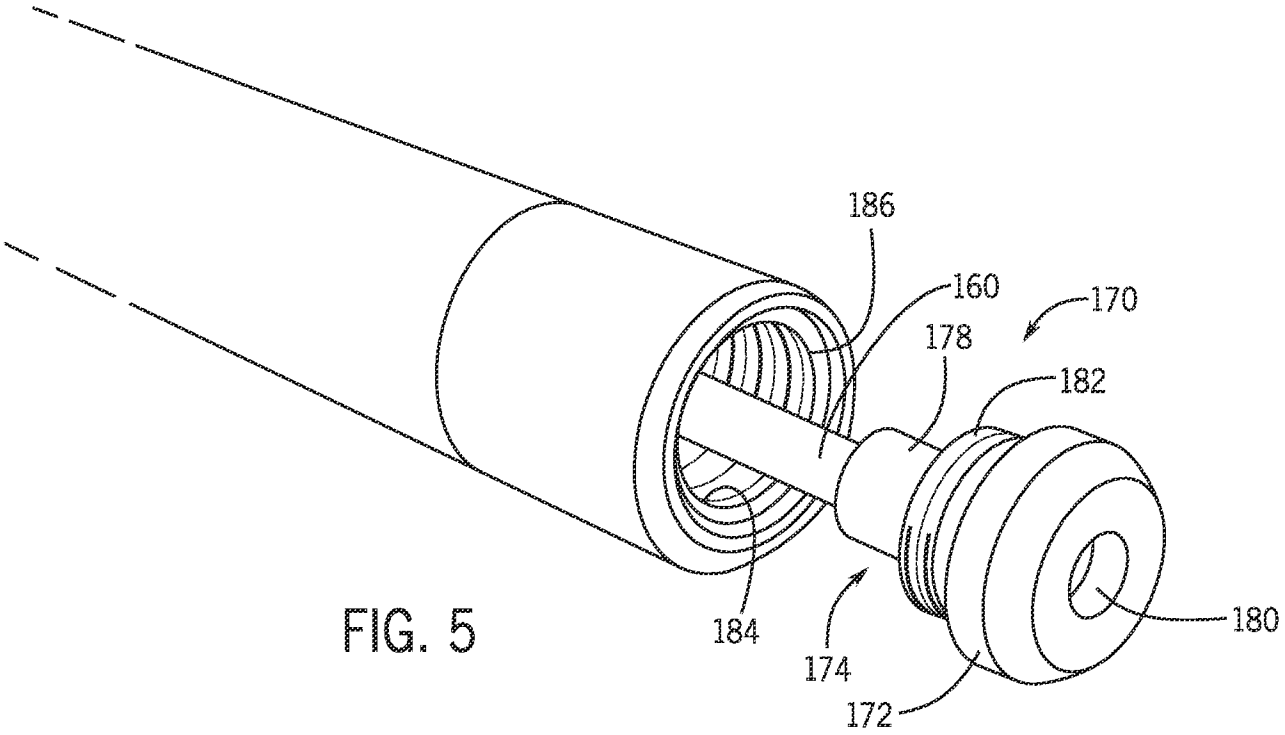
FIG. 5 is a perspective view of the butt plate system and engagement with the butt section of a cue as set forth in the present disclosure.

As noted, the first end 162 of the carrier 160 of the VBS weight system 150 includes a butt plate system 170. The butt plate system 170 features an internal threaded construction as described herein permitting easily removal a bumper 172 and access to the carrier 160 along with weights 167 and support washers 165. As shown in FIGS. 3, 4 and 5, butt plate system 170 includes an engagement piece 174. Engagement piece 174 has a first end 176 for receiving bumper 172. The engagement piece 174 has a second end 178 for receiving carrier 160. As shown in FIGS. 3-5, the outer circumference of the second end 178 may be smaller than the outer circumference of the first end 176. Engagement piece 174 has an opening 180 extending through from the first end 176 to the second end 178. The opening 180 at the first end may have a hexagonal cross section for receiving a tool such as an Allen wrench for rotating the engagement piece 174 relative to the butt end 102 of the cue 100. The opening at the second end 178 has a circular cross section and is adapted to receive the first end 162 of the carrier 160. The first end 162 of the carrier 160 may be secured into the opening 180 of the second end 178 of the engagement piece 174 by press fitting, epoxy, glue, soldering or any other methods that secures the carrier 160 in the engagement piece 170. Located distally adjacent to the second end 178 is a threaded engagement portion 182. Threaded engagement portion 182 interacts with threads 184 located on an interior surface of the butt end 102 as shown in FIG. 5. Located distally to the threaded engagement portion 182 of the engagement piece 174 is a circumferential flange 188. When the threaded engagement portion 182 is fully engaged with threads 184 of the butt section 102, the circumferential flange 188 fits into a recess 186 located at the terminal end of the butt section 102 distal to the threads 184.

In operation, when the cue 100 is fully assembled, a user may insert a tool such as an Allen wrench into the opening 180 at the first end 176 of the engagement piece to unscrew the engagement piece (with bumper 172 attached) from the butt section 102. Once unscrewed, the user may then remove the VBP weight system 150, including butt plate system 170 and carrier 160, as one unit from the support tube 120 secured in the butt section 102. The user may then slidably adjust the weights 167 and support washers 165 into a desired configuration as described herein. Once, the desired configuration is achieved, the VBP weight system is re-inserted into the support tube 120 located in the butt section 102 and the butt plate system is re-secured into place by engaging threads 182 with threads 184.

It should be appreciated that the present disclosure thus provides a method of constructing and assembling a weighted cue and particularly the butt section thereof which is faster, more efficient, less costly and free from manufacturing obstacles normally known to those in cue stick production. Specifically, there is no need individually screwing on weights onto an elongated threaded bar as in the prior art. Various alternatives are contemplated as being within the scope of the following claims particularly pointing out and distinctly claiming the subject matter regarded as the invention.

What is claimed is:

1. A variable balance weight system configured to be received in a butt section of a cue used in billiards games, the weight system comprising:

a support tube configured to be received in the butt section of the cue;

a carrier configured to be removably received in the support tube;

at least one weight slidably supported on the carrier;

a plurality of support washers slidably supported on the carrier;

a butt plate secured to a first end of the carrier;

a reference designation system establishing a neutral location for the at least one weight on the carrier based on a center of gravity of the cue; and wherein the at least one weight and the plurality of support washers are configured to be adjusted to different locations along the length of the carrier based on the neutral location to adjust the balance of the cue.

2. The variable balance weight system of claim 1, wherein the reference designation system provides a plurality of reference points for adjusting the locations the at least one weight and the plurality of support washers along the length of the carrier relative to the neutral location.

3. The variable balance weight system of claim 1, wherein the location of the neutral location is selected based on the center of gravity of the cue.

4. The variable balance weight system of claim 1, wherein the reference designation system delineates a plurality of sections along the length of the carrier.

5. The variable balance weight system of claim 4, wherein each of the plurality of sections are equal in length.

6. The variable balance weight system of claim 1, wherein the plurality of support washers are configured to support the at least one weight at a location along the carrier.

7. The variable balance weight system of claim 1, wherein the at least one weight includes a plurality of weights.

8. The variable balance weight system of claim 7, wherein a first one of the plurality of weights has at least one of a different mass and a different size than a second one of the plurality of weights.

9. The variable balance weight system of claim 1, wherein each of the at least one weights includes at least one recessed screw for moving and securing each weight at a desired location along the length of the carrier.

10. A variable balance weight system for a cue used in billiards games, the weight system comprising:

a carrier having a length extending from a first end to a second end and including a reference designation system;

one or more weights slidably supported on the carrier;

two or more support washers slidably supported on the carrier;

a butt plate secured to the first end of the carrier, the butt plate having a first end and a second end and including an opening extending from the first end to the second end, the opening having a circular cross section at a second end for receiving the carrier of the weight system;

wherein the one or more weights and the two or more washers may be adjusted to different locations along the length of the carrier based on the reference designation system.

11. The variable balance weight system of claim 10, wherein the reference designation system extends the length of the carrier; and wherein the reference designation system establishes a neutral or standard location for the one or more weights and two or more support washers along the carrier.

12. The variable balance weight system of claim 11, wherein the reference designation system provides reference points for adjusting the locations of the one or more weights and two or more support washers along the length of the carrier relative to the neutral or standard location.

13. The variable balance weight system of claim 11, wherein the neutral or standard location of the reference designation system is based on a center of gravity of the cue and the weight system.

14. The variable balance weight system of claim 10, wherein the one or more weights include at least one recessed screw for moving and securing each weight at a desired location along the length of the carrier.

15. The variable balance weight system of claim 10, wherein a distal end of the butt plate includes a bumper.

16. The variable balance weight system of claim 10, wherein the opening of the butt plate at a first end has a hexagonal cross section.

17. The variable balance weight system of claim 10, wherein the system includes two or more weights.

18. The variable balance weight system of claim 10, wherein the system includes three or more weights.

19. The variable balance weight system of claim 10, wherein the weights are cylindrical and have different lengths and weights.

* * * * *